US008387669B2

(12) United States Patent
Chen

(10) Patent No.: US 8,387,669 B2
(45) **Date of Patent: *Mar. 5, 2013**

(54) GOLF CLUB HEAD COVERS AND RELATED METHODS

(75) Inventor: Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 557 days.

This patent is subject to a terminal disclaimer.

(21) Appl. No.: 12/616,703

(22) Filed: Nov. 11, 2009

(65) Prior Publication Data

US 2010/0051151 A1 Mar. 4, 2010

Related U.S. Application Data

(63) Continuation-in-part of application No. 12/549,310, filed on Aug. 27, 2009, now Pat. No. 7,954,526, which is a continuation of application No. 11/193,098, filed on Jul. 29, 2005, now Pat. No. 7,597,126.

(51) Int. Cl.
*B65D 65/02* (2006.01)

(52) U.S. Cl. ..... 150/160; 206/818

(58) Field of Classification Search ..... 150/160; 206/818

See application file for complete search history.

(56) References Cited

U.S. PATENT DOCUMENTS

| | | | | |
|---|---|---|---|---|
| 3,133,577 | A | 5/1964 | Bellevue, Sr. | |
| D202,200 | S | 9/1965 | Bates | |
| 3,861,434 | A | 1/1975 | Harding | |
| 3,938,570 | A | 2/1976 | Stewart | |
| 4,667,716 | A | 5/1987 | Solheim | |
| 4,858,361 | A | 8/1989 | White | |
| 5,005,624 | A | 4/1991 | Sung | |
| 5,146,968 | A | 9/1992 | Meek | |
| 5,437,320 | A | 8/1995 | Sung | |
| 6,095,214 | A | 8/2000 | Gaffney | |
| 6,119,742 | A | 9/2000 | Maeng | |
| 6,202,723 | B1 | 3/2001 | Maeng | |
| D444,525 | S | 7/2001 | Bernath | |
| D447,202 | S | 8/2001 | Besnard et al. | |
| 6,321,805 | B1 | 11/2001 | Suggs | |
| D535,344 | S | 1/2007 | Chen | |
| 7,597,126 | B2 * | 10/2009 | Chen | 150/160 |
| 2004/0173484 | A1 | 9/2004 | Bates et al. | |
| 2005/0016648 | A1 | 1/2005 | Vakharia et al. | |

FOREIGN PATENT DOCUMENTS

| | | | |
|---|---|---|---|
| GB | 2327363 | A | 1/1999 |
| JP | 2003225335 | A | 8/2003 |
| JP | 2003265662 | A | 9/2003 |
| JP | 2004-57259 | * | 2/2004 |

* cited by examiner

*Primary Examiner* — Tri Mai

(57) ABSTRACT

Embodiments of golf club head covers are described herein. Other embodiments and related examples comprising magnetic elements are also described herein.

14 Claims, 6 Drawing Sheets

GOLF CLUB HEAD COVERS AND RELATED METHODS

CROSS REFERENCE TO RELATED APPLICATIONS

This application is a continuation in part of U.S. patent application Ser. No. 12/549,310, filed Aug. 27, 2009, which is a continuation of U.S. patent application Ser. No. 11/193,098, filed Jul. 29, 2005. Both applications are incorporated herein by reference.

TECHNICAL FIELD

This invention relates generally to sports equipment, and relates, more particularly, to golf club head covers and related methods.

BACKGROUND

Proper care of golf clubs is desirable to maximize their usable life and to maintain their performance. An important aspect of proper care includes protecting golf club heads from damage, such as from impact with other golf club heads, or from exposure to environmental elements when not in use. Club head covers are widely used for many types of golf clubs, such for as putters and woods. Many prior club head covers, however, lack proper means for securing to the golf club heads, or comprise cumbersome or ineffective means for securing that discourage their frequent use.

Accordingly, needs exist for an apparatus and/or related methods capable of overcoming the limitations described above.

BRIEF DESCRIPTION OF THE DRAWINGS

To facilitate further description of the embodiments, the following drawings are provided in which.

Figure 1:
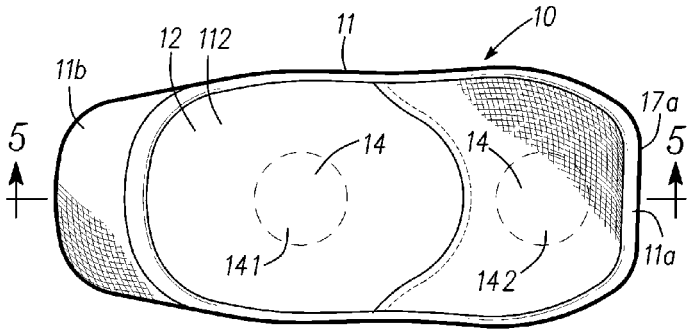
FIG. 1 is a top view of a golf club head cover defining a compartment in accordance with the present invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements, mechanically or otherwise, whether directly or indirectly. Coupling may be for any length of time, e.g., permanent or semi-permanent or only for an instant. A mechanical "coupling" and the like should be broadly understood and include mechanical coupling of all types. The absence of the word "removably," "removable," and the like near the word "coupled," and the like does not mean that the coupling, etc. in question is or is not removable.

DESCRIPTION

In one embodiment, a club head cover for housing a club head of a club comprises a body defining a compartment, and first and second magnetic elements. The body has a bottom portion, a left portion coupled to the bottom portion, a right portion coupled to the bottom portion opposite the left portion, a rear portion located between the left and right portions and towards a heel end of the club head cover, a front portion located between the left and right portions and towards a toe end of the club head cover, a top portion coupled between the left and right portions and opposite the bottom portion towards the front portion, and a perimeter of an opening, the opening located between the left and right portions and opposite the bottom portion towards the rear portion. An insertion facilitator is also coupled to the body to facilitate insertion of the club head into the compartment. The first magnetic element is located towards a first one of the rear portion or the front portion of the body, and the second magnetic element is located towards a second one of the rear portion or the front portion of the body. The first and second magnetic elements are configured to secure the club head cover to the club head when the club head is located adjacent to the bottom portion and within the compartment. Other variations, examples, and embodiments are described herein.

Referring to FIGS. 1-4, a golf club head cover 10 is sized and shaped to fit on a golf club head of a golf club (not shown). Club head cover 10 includes body 11 having bottom wall 12 with magnetic means, such as a plurality of magnets 14, secured (i.e., embedded) in bottom wall 12. Club head cover 10 also includes a pair of side walls 16 which extend from bottom wall 12 to form compartment 18 for containing the golf club head. There can be embodiments where compartment 18 may be referred to as a pocket. Magnets 14 hold club head cover 10 on the club head when the club head is contained or housed in compartment 18. Side walls 16 also define opening 20 through which the club head may be inserted into or removed from compartment 18. Opening 20 is further defined by a pair of end walls 17*a*, 17*b* extending between side walls 16. End wall 17*b* is located closer to toe end 11*b* of body 11 than to heel end 11*a* of body 11. End wall 17*b* has a substantially U-shaped opening extension 19 formed therein in the present example, although in other examples opening extension 19 may comprise other geometric shapes, such as a square or rectangular shape, a V-shape, a polygonal shape, or an irregular shape. There can be examples where opening extension 19 can be referred to as an aperture. Opening extension 19 can also comprise a surface, such as fulcrum 30 in the present example, that can be used to facilitate pivoting of a portion of the golf club, such as a portion of a golf club head, a shaft or a hosel of the golf club head, when the golf club head is inserted into compartment 18.

The different walls of club head cover 10, such as bottom wall 12 and side walls 16, may be formed from a variety of materials, such as leather, synthetic rubber, neoprene, polyethylene, polyurethane, ABS or other plastic or fabric materials. Magnets 14 facilitate use of club head cover 10 without undue manipulation, thereby promoting frequent use of club head cover 10. Because club head cover 10 is held and secured on the club head by magnetic force, no other fastening devices are needed to prevent club head cover 10 from being inadvertently removed from the club head under normal conditions.

In the present embodiment, the magnetic elements of magnets 14 are generally cylindrical with a thickness of about 3 millimeters (mm) and a diameter of about 20 mm. One of magnets 14 is located adjacent heel end 11*a* of body 11, while the other one of magnets 14 is located adjacent toe end 11*b* of body 11. Each of magnets 14 may be held in place in or at bottom wall 12 by adhesives, rivets, stitching, or other conventional means. Alternatively, magnetic elements of different sizes and/or shapes may be used instead of magnets 14. For example, a strip of magnetic material (not shown) extending longitudinally relative to bottom wall 12 may be used. There can be other examples that have other types of magnetic elements, such as one or more layers or patches of magnetic fabric that may be located similar to magnets 14. There can be other embodiments where magnetic elements may be otherwise coupled or secured to club head cover 10 without being embedded into a portion thereof. For example, magnets 14 may be coupled to or over an interior surface of bottom wall 12 in some examples.

Figure 5:
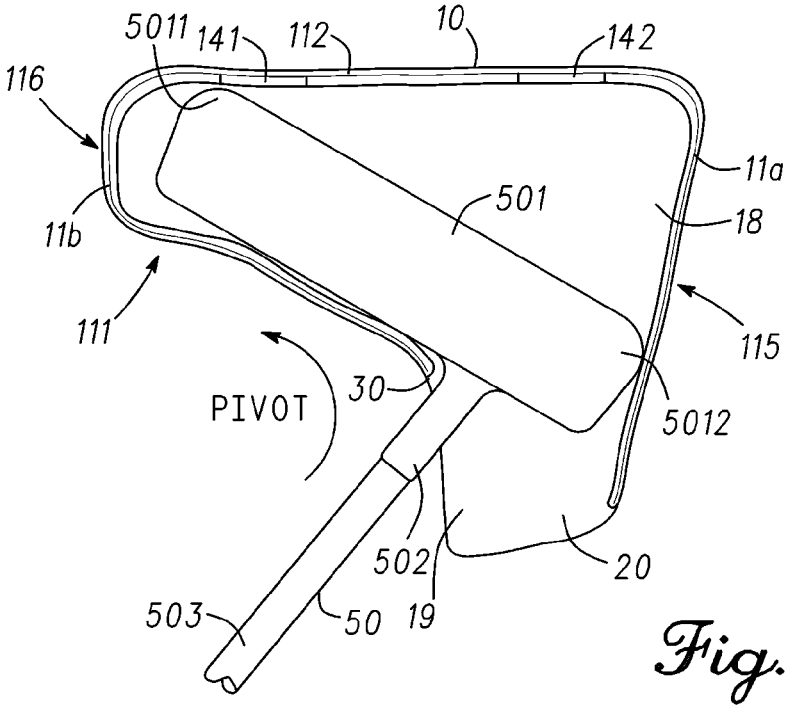
FIG. 5 illustrates a cross-sectional view taken along section line 5-5 in FIG. 1 of the club head cover of FIGS. 1-4 during insertion of a club head of a club into the compartment.
Figure 6:
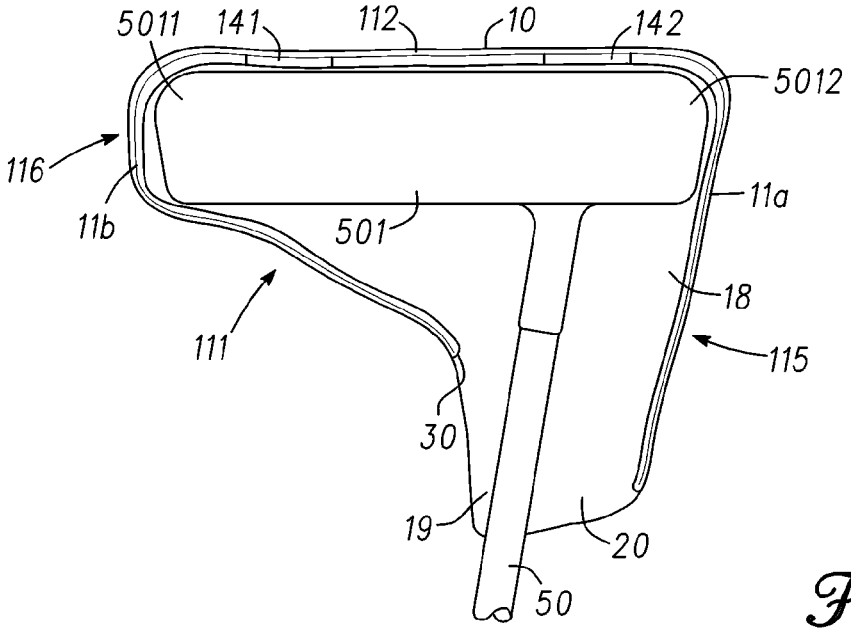
FIG. 6 illustrates the cross-sectional view of FIG. 5 after insertion of the club head into the compartment.

In the present embodiment, club head cover 10 is a putter head cover for use on a golf putter head. In other embodiments, club head cover 10 may be configured to also or alternatively accommodate other types of club heads, such as wood heads and/or iron heads. Skipping ahead in the figures, as seen in FIGS. 5-6, club head cover 10 can be used to cover club head 501 of club 50, where club 50 is representative of different kinds of golf clubs such as putters, woods, wedges, hybrids, and/or irons.

With reference again to FIGS. 1-4, it will be understood that magnetic elements, such as magnets 14 or others similar thereto, could be coupled to other locations of club head cover 10 in other embodiments, such as to one or both of side walls 16 and/or to other portions of club head cover 10, rather than only to bottom wall 12. Also, it will be understood that the magnetic force of the magnets 14 permits a golfer to use a golf club to easily retrieve the club head cover 10 without bending over or squatting down.

Although the description above for FIGS. 1-4 describes different parts of club head cover 10 as comprising "walls," it will be understood that two or more of such "walls" may comprise a single piece of material shaped or bent to define body 11. For example, side walls 16 in the present embodiment can comprise a single piece of material that circumscribes body 11, including heel end 11*a* and/or toe end 11*b*. There can be other embodiments where side walls 16 and bottom wall 12 can comprise a single piece of material. Further embodiments are possible where other combinations of walls or portions of body 11 can comprise a single piece of material.

The present example of FIGS. 1-4 can also be described in terms of several portions thereof, where such several portions of club head cover 10 combine to define compartment 18. For example, compartment 18 is defined by bottom portion 112, left portion 113 coupled to bottom portion 112, right portion 114 coupled to bottom portion 112 opposite left portion 113, rear portion 115 located between left portion 113 and right portion 114 towards heel end 11*a*, front portion 116 located between left portion 113 and right portion 114 towards toe end 11*b*, top portion 111 coupled between left portion 113 and right portion 114 and opposite bottom portion 112 and towards front portion 116, and perimeter 120 of opening 20 located between left portion 113 and right portion 114 and opposite bottom portion 112 and towards rear portion 115. Magnetic elements in the form of magnets 14 are located at bottom portion 112, where magnet 141 is located towards front portion 116, and magnet 142 is located towards rear portion 115, to secure club head cover 10 to the club head when the club head lies adjacent to bottom portion 112 and within compartment 18. In some examples, a pair of portions similar to left and right portions 113 and 114 can be referred to as a pair of side portions. In the same or other examples, one or more of heel portion 115, top portion 111, and/or front portion 116 can be referred to as end portions.

Figure 3:
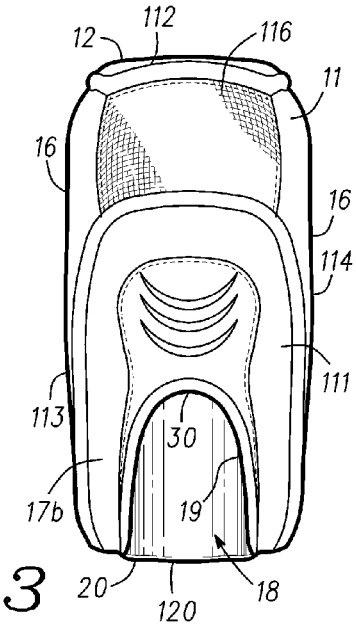
FIG. 3 is an end view of the golf club head cover of FIG. 1.
Figure 2:
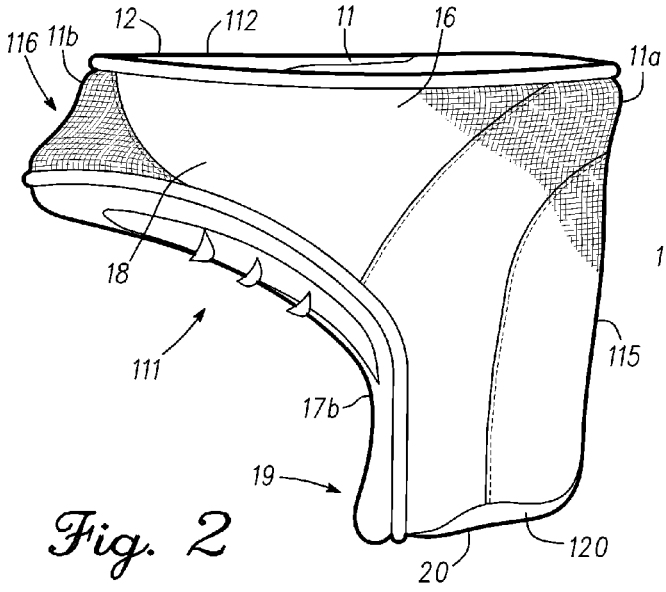
FIG. 2 is a side view of the golf club head cover of FIG. 1.
Figure 4:
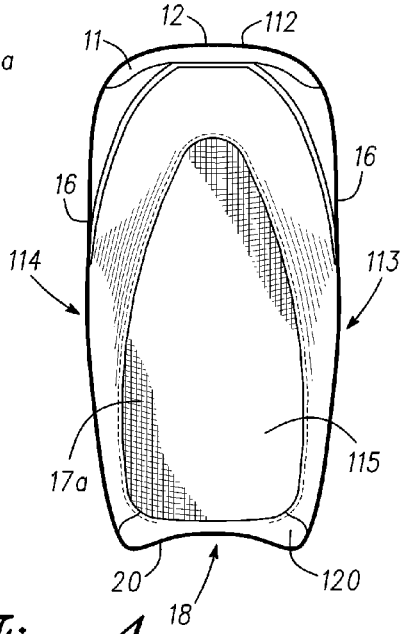
FIG. 4 is an opposite end view of the golf club head cover of FIG. 1.

Continuing with the figures, FIG. 5 illustrates a cross-sectional view of club head cover 10 during insertion of club head 501 of club 50 into compartment 18. FIG. 6 illustrates a cross-sectional view of club head cover 10 with club head 501 secured by magnets 141 and 142 after insertion into compartment 18. Opening extension 19, as shown in FIG. 3, defines an extension of opening 20 at top portion 111, from perimeter 120 towards bottom portion 112. As seen in FIGS. 5-6, opening extension 19 can serve as an insertion facilitator to insert club head 501 into compartment 18, where fulcrum 30 can serve as a pivot point for club head 501, hosel 502, and/or shaft 503 when pivoting club head 501 into compartment 18. Because magnets 141 and 142 are located towards front and rear portions 116 and 115, respectively, of club head cover 10, there is no magnetic friction to impede the pivoting or displacement of club head 501 as it traverses proximate to bottom portion 112 or across a central region of bottom portion 112, until toe end 5011 of club head 501 approaches or reaches its destination adjacent to magnet 141 towards front end 116.

Figure 7:
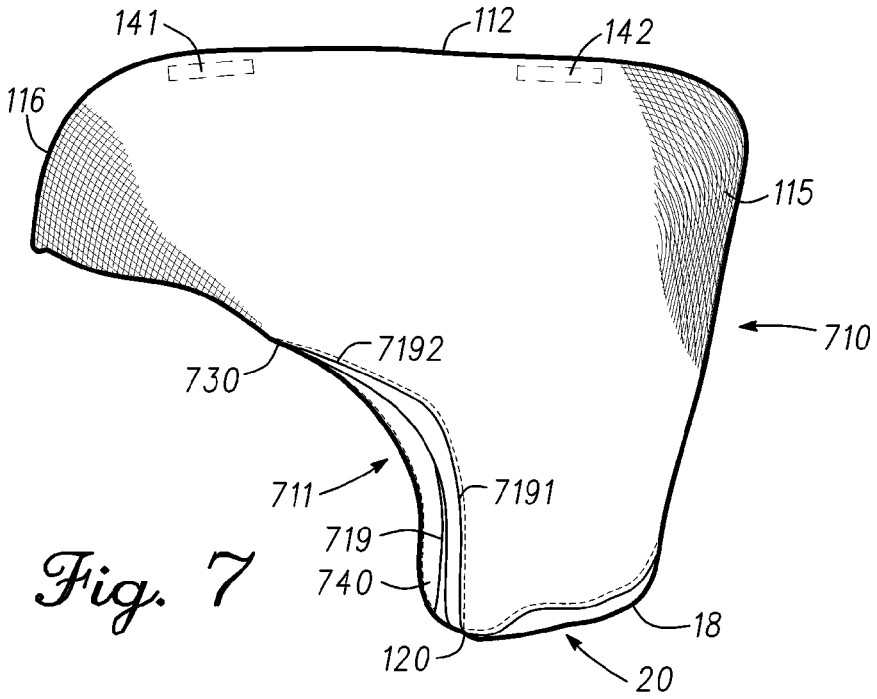
FIG. 7 illustrates a side view of a second club head cover similar to the club head cover of FIGS. 1-6.
Figure 8:
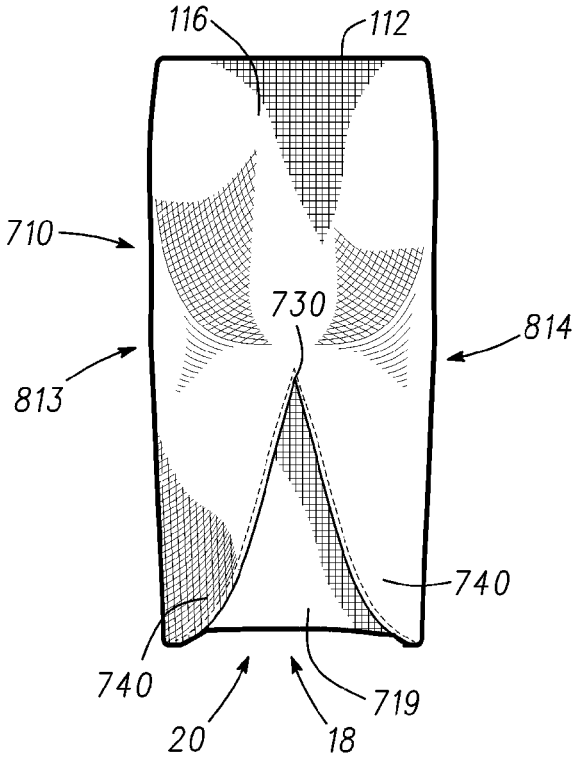
FIG. 8 illustrates a front view of the club head cover of FIG. 7.

Moving along, FIG. 7 illustrates a side view of club head cover 710. FIG. 8 illustrates a front view of club head cover 710. Club head cover 710 is similar to club head cover 10 (FIGS. 1-6), but has opening extension 719 rather than opening extension 19 (FIGS. 3, 5-6) as an insertion facilitator. Like opening extension 19, opening extension 719 has a width configured to accommodate hosel 502 or shaft 503 (FIGS. 2-3, 5-6) during insertion and/or pivoting of club head 501 into compartment 18. In the present example, however, opening extension 719 is located at top portion 711 of club head cover 710, and is larger than opening extension 19 while defining an extension of opening 20. For example, opening extension 719 extends from perimeter 120 of opening 20 towards front portion 116, wherein segment 7191 of opening extension 719 extends from perimeter 120 of opening 20 towards bottom portion 112, and wherein segment 7192 of opening extension 719 extends from segment 7191 towards front portion 116. In the present and other examples, club head 501 can be inserted into compartment 18 of club head cover 710 by a pivoting action similar to the description above for FIGS. 5-6. In the same or other examples, such pivoting can be assisted by, or rotated about, fulcrum 730 of opening extension 719. To further facilitate insertion of club head 501 into compartment 18, opening extension 719 extends longer than opening extension 19 of club head cover 10 (FIGS. 2-3, 5-6) to limit the amount of pivoting needed for insertion. As an example, opening extension 719 extends along top portion 711 of club head cover 710 throughout at least approximately one third of a distance between perimeter 120 and toe end 11*b*.

In the present embodiment of FIGS. 7-8, club head cover 710 also has flaps 740 coupled to a perimeter of opening extension 719, where flaps 740 can comprise a flexible material such as cloth or leather to at least partially cover opening extension 719 or a view into compartment 18. Although FIGS. 7-8 show two flaps 740 coupled to respective portions of the perimeter of opening extension 719, there can be embodiments where only a single flap is coupled to part of the perimeter of opening extension 719. There can also be other embodiment that comprise no flaps.

Figure 9:
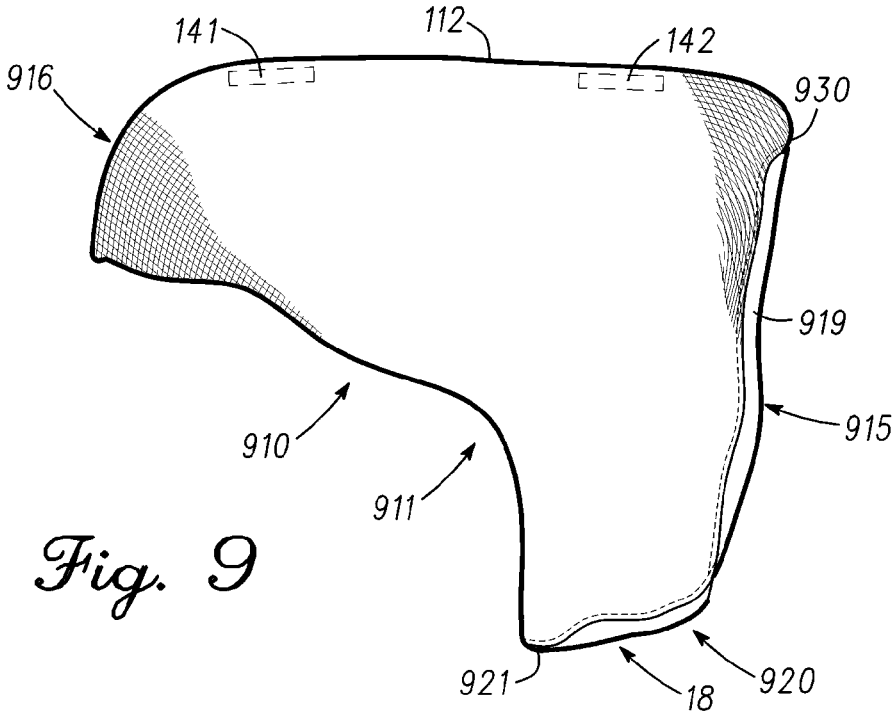
FIG. 9 illustrates a side view of a third club head cover similar to the club head covers of FIGS. 1-8.
Figure 10:
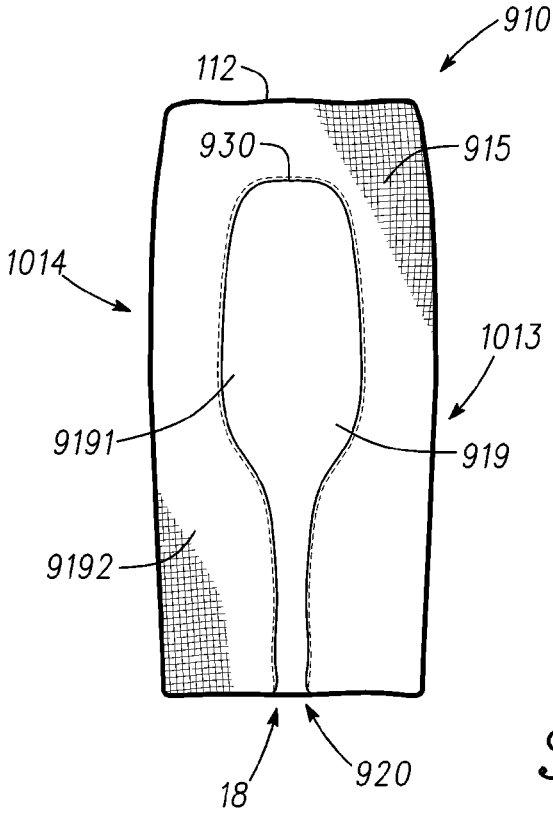
FIG. 10 illustrates a front view of the club head cover of FIG. 9.

Continuing with the figures, FIG. 9 illustrates a side view of club head cover 910. FIG. 10 illustrates a front view of club head cover 910. Club head cover 910 is similar to club head covers 10 (FIGS. 1-6) and 710 (FIGS. 7-8), but has opening extension 919 as an insertion facilitator at rear portion 915. Perimeter 921 of opening 920 of club head cover 910 is similar to perimeter 120 of opening 20 in FIGS. 2-4, but leaves a gap towards rear portion 915 as seen in FIGS. 9-10. Opening extension 919 extends from perimeter 921 of opening 920 towards bottom portion 112, and has section 9191 towards bottom portion 112 configured to accommodate a width of club head 501 (FIGS. 5-6) during insertion thereof into compartment 18. Opening extension 919 also has section 9192 located between section 9191 and perimeter 921 of opening 920. In the present example, section 9192 is narrower than section 9191, where a width of section 9192 is configured to accommodate a width of hosel 502 and/or shaft 503 during insertion of club head 501 into compartment 18. There can be other examples, however, where section 9192 need not be narrower than section 9191. In embodiments such as the present one, rear portion 915 also has lip 930 between opening extension 919 and bottom portion 112, where lip 930 can restrict club head 501 from being unwantedly or inadvertently removed from compartment 18 in a single rearward motion, and/or can enhance the appearance or fit of club head cover 910 over club head 501 by covering or corralling at least a portion of heel end 5012 of club head 501 (FIGS. 5-6).

Figure 11:
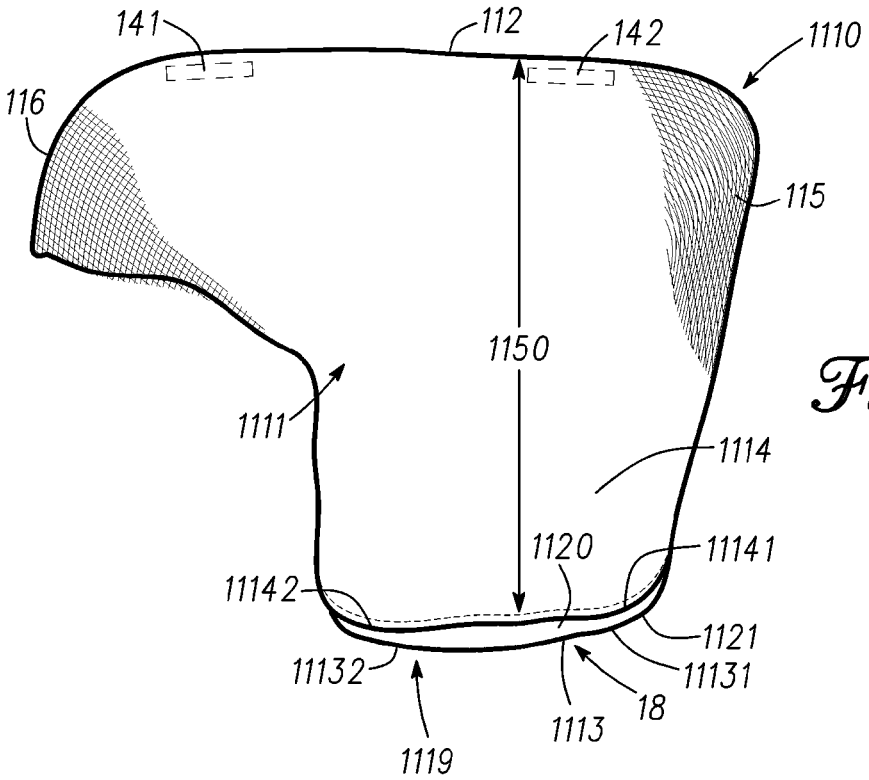
FIG. 11 illustrates a side view of a fourth club head cover similar to the club head covers of FIGS. 1-10.
Figure 12:
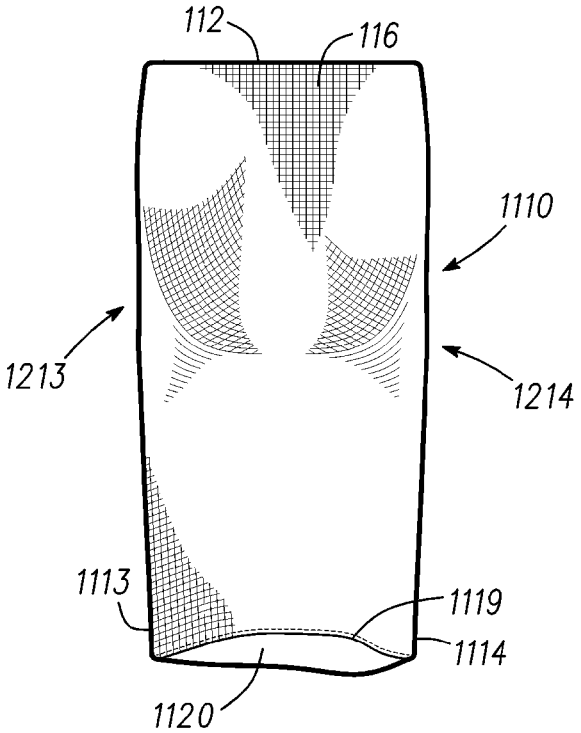
FIG. 12 illustrates a front view of the club head cover of FIG. 11.

Moving on, FIG. 11 illustrates a side view of club head cover 1110. FIG. 12 illustrates a front view of club head cover 1110. Club head cover 1110 is similar to club head covers 10 (FIGS. 1-6), 710 (FIGS. 7-8), and 910 (FIGS. 9-10), but has opening extension 1119 instead as an insertion facilitator. In the present example, club head cover 1110 has left end 1113 opposite bottom end 112, and right end 1114 also opposite bottom end 112. Left end 1113 has segment 11131 extending from rear portion 115 along perimeter 1121 of opening 1120, and also has segment 11132 extending from segment 11131 towards front portion 116. Right end 1114 has segment 11141 extending from rear portion 115 along perimeter 1121 of opening 1120, and also has segment 11142 extending from segment 11141 towards front portion 116. Opening extension 1119 is thus defined between segments 11132 and 11142, and serves as an insertion facilitator by providing a larger aperture through which club head 501 can be inserted into compartment 18 of club head cover 1110. In the present and other examples, the aperture provided by the combined opening extension 1119 and opening 1120 is larger than that provided by only opening 20 (FIGS. 2-8) or opening 920 (FIGS. 9-10). Although segments 11142 and 11132 are shown in FIG. 11 as substantially collinear with segments 11141 and 11131, respectively, there can be other embodiments with angled, curved, or otherwise non-collinear relationships.

There can also be other embodiments similar to club head cover 1110, but where the size of opening 1120 and/or opening extension 1119 differ based on a height of such covers. For example, in an embodiment comprising a height less than height 1150 of club head cover 1110, opening 1120 and/or opening extension 1119 could comprise smaller dimensions while still properly facilitating insertion of club head 501 (FIGS. 5-6). In such examples, club head 501 may enter compartment 18 in a more direct way, such that less pivoting may be required to bring toe end 5011 of club head 501 adjacent to front portion 116, and such that a smaller opening 1120 and/or opening extension 1119 could suffice for properly facilitating insertion.

As seen in the embodiments of FIGS. 1-12, magnetic elements such as magnets 14 and/or magnetic fabric layers or patches can be used regardless of the type of insertion facilitator provided by the respective club head covers. As an example, all of club head covers 10 (FIGS. 1-6), 710 (FIGS. 7-8), 910 (FIGS. 9-10), and 1110 (FIGS. 11-12) comprise magnets 14 as magnetic elements.

Figure 13:
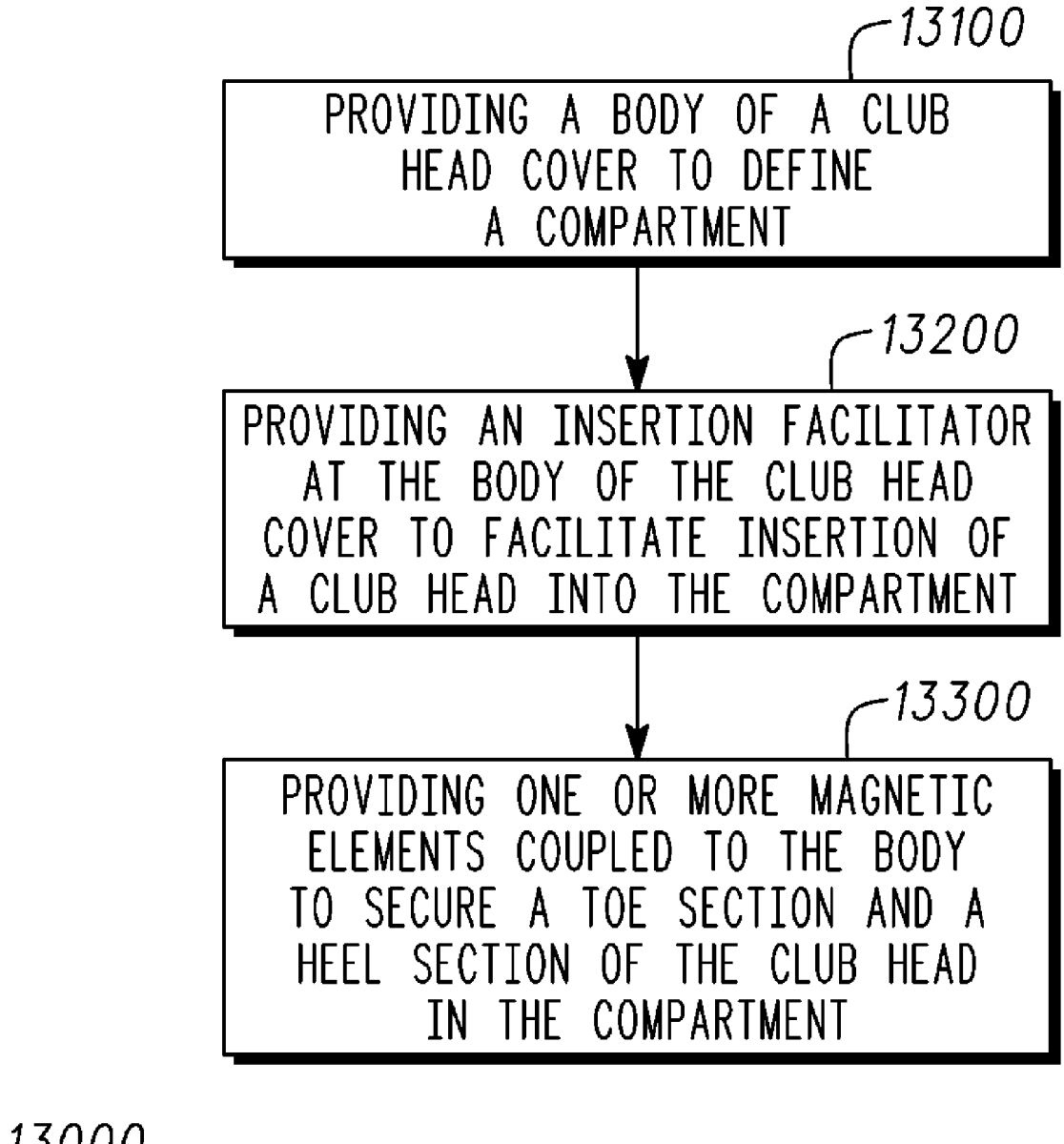
FIG. 13 illustrates a flowchart of a method for providing a club head cover in accordance with the present disclosure.

Continuing with the figures, FIG. 13 illustrates a flowchart of method 13000 for providing a club head cover in accordance with the present disclosure. In some examples, the club head cover of method 13000 can be similar to one or more of club head cover 10 (FIGS. 1-6), club head cover 710 (FIGS. 7-8), club head cover 910 (FIGS. 9-10), club head cover 1110 (FIGS. 11-12), or similar other club head covers. The club head cover of method 13000 can be used to cover and/or protect a club head inserted therein, including golf club heads like club head 501 of club 50 (FIGS. 5-6).

Block 13100 of method 13000 involves providing a body of the club head cover to define a compartment. There can be examples where the body of the club head cover can be similar to body 11 of club head cover 10 (FIGS. 1-6), and/or to a body of club head cover 710 (FIGS. 7-8), club head cover 910 (FIGS. 9-10), club head cover 1110 (FIGS. 11-12), or similar other club head covers. The compartment can be similar to compartments described above for said club head covers, such as compartment 18 (FIGS. 1-12).

Block 13100 can involve several different steps in some examples. For instance, block 13100 can involve providing a bottom portion of the body, where the bottom portion can be similar to bottom portion 112 as described above for FIGS.

1-12. In the same or other examples, the bottom portion may be referred to as a sole portion.

Block 13100 can also involve providing a left portion coupled to the bottom portion, and providing a right portion coupled to the bottom portion opposite the left portion. As an example, the left and right portions can be respectively similar to left and right portions 113 and 114 (FIGS. 3-4), to left and right portions 813 and 814 (FIG. 8), to left and right portions 1013 and 1014 (FIG. 10), and/or to left and right portions 1213 and 1214 (FIG. 12).

Block 13100 can also involve providing a rear portion located between the left and right portions and towards a rear end of the club head cover of method 13000, and providing a front portion located between the left and right portions and towards a front end of the club head cover. As an example, the rear and front portions can be respectively similar to rear and front portions 115 and 116 (FIGS. 2-8, 11-12), and/or to rear and front portions 915 and 916 (FIGS. 9-10).

Block 13100 can also involve providing a top portion coupled between the left and right portions and opposite the bottom portion and towards the front portion. In some embodiments, the top portion may be referred to as a crown portion and/or as a rail portion. In the same or other embodiments, the top portion can be considered as an extension or a part of the front portion. There can be examples where the top portion can be similar to top portion 111 (FIGS. 2-3), to top portion 711 (FIG. 7), to top portion 911 (FIG. 9), and/or to top portion 1111 (FIG. 11).

Block 13100 can involve providing a perimeter of an opening coupled between the right and left portions and opposite the bottom portion and towards the heel portion. As an example, the perimeter or the opening can be similar to perimeter 120 of opening 20 (FIGS. 2-8), to perimeter 921 of opening 920 (FIG. 9), and/or to perimeter 1121 of opening 1120 (FIG. 11).

Continuing with method 13000, block 13200 involves providing an insertion facilitator at the body of the club head cover to facilitate insertion of a club head into the compartment. For instance, the insertion facilitator can comprise an aperture that extends the opening described above with respect to block 13100.

In some examples, the insertion facilitator can be similar to opening extension 19 of club head cover 10 (FIGS. 2-3, 5-6). As another example, the insertion facilitator can be similar to opening extension 719 (FIGS. 7-8), where block 13200 of method 13000 can involve providing the opening extension at the top portion of the club head cover to define an extension of the opening extended from the perimeter of the opening towards the front portion of the club head cover. As another example, the insertion facilitator can be similar to opening extension 919 (FIGS. 9-10), where block 13200 of method 13000 can involve providing the opening extension at the rear portion of the club head cover to define an extension of the opening extended from the perimeter of the opening towards the bottom portion of the club head cover. As another example, the insertion facilitator can be similar to opening extension 1119 (FIGS. 11-12), where block 13200 of method 13000 can involve providing the opening extension to be defined opposite the bottom portion and between extended segments of left and right ends of the left and right portions of the club head.

In the same or other examples, providing the insertion facilitator can comprise providing a fulcrum at one of the opening extensions described above to pivot at least one of a portion of a club head, a hosel, or a shaft of the club during insertion into the compartment. In examples where the insertion facilitator has an opening extension similar to that of FIGS. 9-10, providing the rear portion in block 13100 can comprise providing a lip between the opening extension and the bottom portion to corral at least part of the heel section of the club head in the compartment, as described above with respect to lip 930 for FIGS. 9-10.

Method 13000 also involves block 13300 for providing one or more magnetic elements coupled to the body to secure a toe section and a heel section of the club head in the compartment. In some implementations, the magnetic elements can be similar to the magnetic elements as described above with respect to the club head covers of FIGS. 1-12, such as magnets 14, which include magnetic fabric layers or patches. In the same or other implementations, the magnetic elements of block 13300 can be located as shown and/or as described for one or more of the club head covers of FIGS. 1-12. For example, a first magnetic element can be located towards the front portion of the club head cover to secure the toe section of the club head in the compartment. In such examples, the first magnetic element could be located at one of the bottom, left, right, front, or top portions of the club head cover towards the front portion thereof. In the same or other examples, a second magnetic element can be located towards the rear portion of the club head cover to secure the heel section of the club head in the compartment. In such examples, the second magnetic element could be located and/or embedded at one of the bottom, left, right, or rear portions of the club head cover towards the rear portion thereof. There can be other examples comprising more than two magnetic elements, and/or where the first and second magnetic elements comprise a single piece of material.

In some examples, some of the blocks of method 13000 can be subdivided into one or more sub-blocks. For example, block 13100 can be subdivided into several sub-blocks as described above for providing different portions of the body of the club head cover of method 13000.

In the same or other examples, one or more of the different blocks of method 13000 can be combined into a single block or performed simultaneously, and/or the sequence of such blocks can be changed. For example, block 13200 can occur simultaneously with one of the sub-blocks for block 13100 when the insertion facilitator is part of one of the portions provided for the club head cover of method 13000. Similarly, block 13300 can occur simultaneously with one of the sub-blocks of block 13100, such as when the magnetic elements are coupled or embedded in the bottom portion of the club head cover of method 13000.

There can also be examples where method 13000 can comprise further or different blocks. As an example, method 13000 can also comprise a block for inserting the club head into the compartment of the club head cover. Other variations can be implemented for method 13000 without departing from the scope of the present disclosure.

Although the golf club head covers and related methods have been described herein with reference to specific embodiments, various changes or additions may be made without departing from the spirit or scope of the disclosure. For example, a club head cover such as described above may comprise a body portion that encompasses more than one wall of the club head cover. Similarly, there may be embodiments where one wall may form part of more than one body portion of a club head cover. There may be embodiments where the body of the club head cover has more or less pieces of material than the number or walls or portions of the body of that club head cover. For example, a body of a club head cover may be fashioned out of a single piece of continuous material while still comprising front, rear, left, right, bottom, and/or top portions, walls, or ends as described herein. Additional examples of such changes have been given in the foregoing description. Accordingly, the disclosure of embodiments is intended to be illustrative of the scope of the invention and is not intended to be limiting. It is intended that the scope of this application shall be limited only to the extent required by the appended claims. The golf club head covers and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A club head cover to house a club head of a club,
the club head cover comprising:
a body defining a compartment and comprising:
a bottom portion;
a left portion coupled to the bottom portion;
a right portion coupled to the bottom portion opposite the left portion;
a rear portion located between the left and right portions and towards a heel end of the club head cover;
a front portion located between the left and right portions and towards a toe end of the club head cover;
a top portion coupled between the left and right portions and opposite the bottom portion towards the front portion; and
a perimeter of an opening comprising an insertion facilitator to facilitate insertion of the club head into the compartment;
a first magnetic element located towards the front portion;
a second magnetic element located towards the rear portion; and
a first gap that separates the first and second magnetic elements from each other;
wherein:
the opening is located between the left and right portions and opposite the bottom portion towards the rear portion;
the insertion facilitator comprises an opening extension located at the top portion and extended towards the front portion;
the opening extension comprises a fixed fulcrum to pivot at least one of a portion of the club head, a hosel of the club head, or a shaft of the club during insertion of the club head into the compartment;
the fixed fulcrum is non-adjustable relative to the top portion of the body;
the opening extension is devoid of any latching mechanism between opposite sides thereof;
the first and second magnetic elements are configured to secure the club head cover to the club head when the club head is located adjacent to the bottom portion and within the compartment;
a second gap lies between the toe end and the first magnetic element;
a third gap lies between the heel end and the second magnetic element; and
the first, second, and third gaps are devoid of any magnetic elements.

2. The club head cover of claim 1, wherein:
the opening extension comprises a width configured to accommodate at least one of the hosel or the shaft of the club during insertion of the club head into the compartment.

3. The club head cover of claim 1, wherein:
the opening extension comprises:
a first segment extending from the opening towards the bottom portion; and
a second segment extending from the first segment towards the front portion.

4. The club head cover of claim 1, wherein:
the first and second magnetic elements are embedded in the bottom portion and each comprise at least one of:
one or more magnets; or
one or more magnetic fabric layers.

5. The club head cover of claim 1, wherein:
the first magnetic element is located at the bottom portion and is adjacent to the toe end of the club head cover; and
the second magnetic element is located at the bottom portion and is adjacent to the heel end of the club head cover.

6. The club head cover of claim 1, wherein:
the gap is greater than a longest dimension of at least one of the first or second magnetic elements.

7. The club head cover of claim 1, wherein:
the first and second magnetic elements, and the gap, are located at the bottom portion of the body; and
the bottom portion of the body is configured to offer no magnetic friction to a sliding of a toe end of the club head across the gap, as the club head is inserted into position within the club head cover, until the toe end of the club head clears the gap and is adjacent to the first magnetic element.

8. The club head cover of claim 1, wherein:
a clubhead attachment surface of the compartment comprises:
a first magnetic area comprising the first magnetic element;
a second magnetic area comprising the second magnetic element; and
an area greater than the first and second magnetic areas combined, devoid of any magnetic element, and comprising the gap;
and
the clubhead attachment surface comprises the bottom portion and is devoid of any further magnetic areas other than the first and second magnetic areas.

9. The club head cover of claim 1, wherein:
the club head cover is devoid of other fastening devices to prevent the club head cover from being inadvertently removed from the club head.

10. The club head cover of claim 1, wherein:
a perimeter path length around the perimeter of the opening is substantially fixed.

11. A method of providing a club head cover for housing a club head of a club, the method comprising:

providing a body comprising:

a bottom portion;

a left portion coupled to the bottom portion;

a right portion coupled to the bottom portion opposite the left portion;

a rear portion located between the left and right portions and towards a heel end of the club head cover;

a front portion located between the left and right portions and towards a toe end of the club head cover;

a top portion coupled between the left and right portions and opposite the bottom portion towards the front portion; and a perimeter of an opening comprising an insertion facilitator to facilitate insertion of the club head into the compartment;

providing a compartment defined by at least the bottom left, right, and top portions;

coupling a first magnetic element to the body; and coupling a second magnetic element to the body;

wherein:

the opening is located between the left and right portions and opposite the bottom portion towards the rear portion;

the insertion facilitator comprises:

an opening extension located at the top portion and extended towards the front portion; and a fulcrum of the opening extension to pivot at least one of a portion of the club head, a hosel of the club head, or a shaft of the club during insertion of the club head into the compartment;

the first magnetic element is located towards the front portion to secure a toe section of the club head in the compartment;

the second magnetic element is located towards the rear portion to secure a heel section of the club head in the compartment; and a gap separates the first and second magnetic elements from each other and is devoid of any magnetic element.

12. The method of claim 11, wherein:

providing the first magnetic element comprises:

embedding the first magnetic element in the bottom portion; and providing the second magnetic element comprises:

embedding the second magnetic element in the bottom portion.

13. The method of claim 11, wherein:

the gap separates the first and second magnetic elements from each other along the bottom portion, and is greater than a longest dimension of at least one of the first or second magnetic elements;

and the bottom portion offers no magnetic friction to a sliding of a toe end of the club head across the gap, as the club head is inserted into position within the club head cover, until the toe end of the club head clears the gap and is adjacent to the first magnetic element.

14. The method of claim 11, wherein:

providing the body comprises:

providing a clubhead attachment surface comprising:

a first magnetic area comprising the first magnetic element;

a second magnetic area comprising the second magnetic element; and an area greater than the first and second magnetic areas combined, devoid of any magnetic element, and comprising the gap;

and the clubhead attachment surface comprises the bottom portion and is devoid of any further magnetic areas other than the first and second magnetic areas.

* * * * *